US008286700B1

(12) United States Patent
Franchini

(10) Patent No.: US 8,286,700 B1
(45) Date of Patent: Oct. 16, 2012

(54) DAMPING AND SEALING DEVICE FOR A WELL PIPE HAVING AN INNER FLOW PASSAGE AND METHOD OF USING THEREOF

(76) Inventor: Jacob M. Franchini, Aztec, NM (US)

( * ) Notice: Subject to any disclaimer, the term of this patent is extended or adjusted under 35 U.S.C. 154(b) by 347 days.

(21) Appl. No.: 12/644,222

(22) Filed: Dec. 22, 2009

(51) Int. Cl.
*E21B 23/10* (2006.01)

(52) U.S. Cl. ..... 166/156; 166/242.8

(58) Field of Classification Search ..... 166/373, 166/156, 242.6, 242.7, 242.8; 285/316, 302
See application file for complete search history.

(56) References Cited

U.S. PATENT DOCUMENTS 1,836,912 A 12/1931 Fletcher
4,007,784 A 2/1977 Watson et al.
4,410,300 A 10/1983 Yerian
5,526,888 A * 6/1996 Gazewood ..... 175/320
5,915,478 A 6/1999 Brown et al.
6,079,488 A * 6/2000 Begg et al. ..... 166/50
7,314,080 B2 1/2008 Giacomino
2006/0054329 A1 3/2006 Chisholm
2007/0247969 A1 10/2007 Dougherty, Sr. et al.

* cited by examiner

*Primary Examiner* — Cathleen Hutchins
(74) *Attorney, Agent, or Firm* — Simpson & Simpson, PLLC

(57) ABSTRACT

A damping and sealing device for enabling gas or liquid flow from a well to a production tube in the well, including a body with a flow passage internal to the body and a spring disposed about a portion of the body. The flow passage includes a first opening at a first longitudinal end of the body and a second opening at a second longitudinal end of the body. The first end is arranged to contact a plunger for the well and the body is arranged to sealingly engage the production tube. In one embodiment, the body includes an inner circumferential surface and an outer circumferential surface, the inner circumferential surface forms the internal flow passage, and a portion of the outer circumferential surface is arranged to slide along a portion of the inner circumferential surface in response to the first end contacting a plunger.

8 Claims, 7 Drawing Sheets

DAMPING AND SEALING DEVICE FOR A WELL PIPE HAVING AN INNER FLOW PASSAGE AND METHOD OF USING THEREOF

FIELD OF THE INVENTION

The present invention relates generally to a damping and sealing device for a well. More specifically, the present invention relates to a damping and sealing device, for a gas and/or oil well, having an internal flow passage.

BACKGROUND OF THE INVENTION

FIG. 5 is a side view of typical, or conventional, bumper spring 200 in a production tube.

FIG. 6 is a side view of a typical, or conventional, well showing an arrangement and location for bumper spring arrangement 202. The following should be viewed in light of FIGS. 5 and 6. Bottom-hole bumper springs, such as spring 200 shown in FIG. 5, are typically used in wells, such as well 204, with plunger artificial lift systems. Due to the construction of the bumper springs, the flow path taught for production tubes, such as tube 206, is restricted to the space through sealing portion 207 and then through the space between an outer circumference of the bumper spring, for example, as defined by the outer circumference of spring 208, and the production tube. This flow path is shown in FIG. 5. To more clearly illustrate this flow path, the size of the space noted above has been exaggerated in FIG. 5.

Operation of a typical bottom-hole bumper spring is predicated upon placing a spring in the space noted above to absorb the impact of a plunger. Typically, the operation of the bumper spring is further based on restricting the size of the portion of the bumper spring impacted by a plunger to fit within the area formed by the outer diameter of the spring. Thus, the area available for flow past the bumper spring also is restricted to the area between the portion of the bumper spring impacted by a plunger and the inner diameter of the production tube.

BRIEF SUMMARY OF THE INVENTION

The present invention broadly comprises a damping and sealing device for enabling gas or liquid flow from a well to a production tube in the well, including a body; a flow passage internal to the body and including a first opening at a first longitudinal end of the body and a second opening at a second longitudinal end of the body; and a spring disposed about at least a portion of the body. The first end is arranged to receive a plunger in the well and the body is arranged to sealingly engage the production tube. In an example embodiment, the body includes first and second segments, the first segment includes an inner circumferential surface forming a portion of the flow passage, and the second segment includes an outer circumferential surface arranged to slide along the inner circumferential surface in response to a plunger contacting the first end. In an example embodiment, the first and second segments are interlocked. In an example embodiment, the body includes first and second segments, the first segment includes an inner circumferential surface forming a portion of the flow passage, and the second segment includes an outer circumferential surface slideable along the inner circumferential surface. In an example embodiment, the body includes an inner circumferential surface and an outer circumferential surface and a portion of the outer circumferential surface is slidingly engaged with a portion of the inner circumferential surface.

The present invention also broadly comprises a damping and sealing device for enabling gas or liquid flow from a well to a production tube in the well, including a body; a flow passage radially within the body; and a spring disposed about a portion of the body and radially aligned with a portion of the flow passage.

The present invention further broadly comprises a damping and sealing device for enabling gas or liquid flow from a well to a production tube in the well, including a body; a flow passage through the body; and a spring surrounding a portion of the body. The portion of the body is disposed between the flow passage and the spring.

The present invention broadly comprises a method for producing a well.

A general object of the present invention is to provide a device providing sufficient shock protection for down-hole components while maximizing flow through the bumper spring to a production tube.

This and other objects, features and advantages of the present invention will become readily apparent to those having ordinary skill in the art from a reading and study of the following detailed description of the invention, in view of the drawing and appended claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. It is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, example methods, devices, and materials are now described.

Figure 1A:
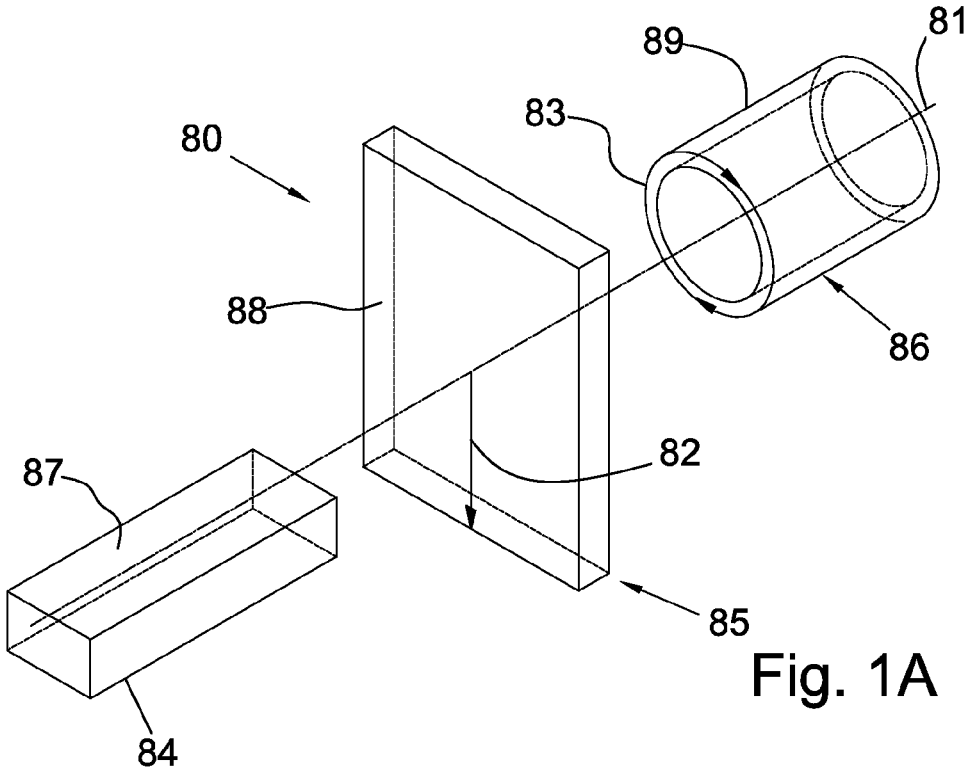
FIG. 1A is a perspective view of a cylindrical coordinate system demonstrating spatial terminology used in the present application.

FIG. 1A is a perspective view of cylindrical coordinate system 80 demonstrating spatial terminology used in the present application. The present invention is at least partially described within the context of a cylindrical coordinate system. System 80 has a longitudinal axis 81, used as the reference for the directional and spatial terms that follow. The adjectives "axial," "radial," and "circumferential" are with respect to an orientation parallel to axis 81, radius 82 (which is orthogonal to axis 81), and circumference 83, respectively. The adjectives "axial," "radial" and "circumferential" also are regarding orientation parallel to respective planes. To clarify the disposition of the various planes, objects 84, 85, and 86 are used. Surface 87 of object 84 forms an axial plane. That is, axis 81 forms a line along the surface. Surface 88 of object 85 forms a radial plane. That is, radius 82 forms a line along the surface. Surface 89 of object 86 forms a circumferential plane. That is, circumference 83 forms a line along the surface. As a further example, axial movement or disposition is parallel to axis 81, radial movement or disposition is parallel to radius 82, and circumferential movement or disposition is parallel to circumference 83. Rotation is with respect to axis 81.

The adverbs "axially," "radially," and "circumferentially" are with respect to an orientation parallel to axis 81, radius 82, or circumference 83, respectively. The adverbs "axially," "radially," and "circumferentially" also are regarding orientation parallel to respective planes.

Figure 1B:
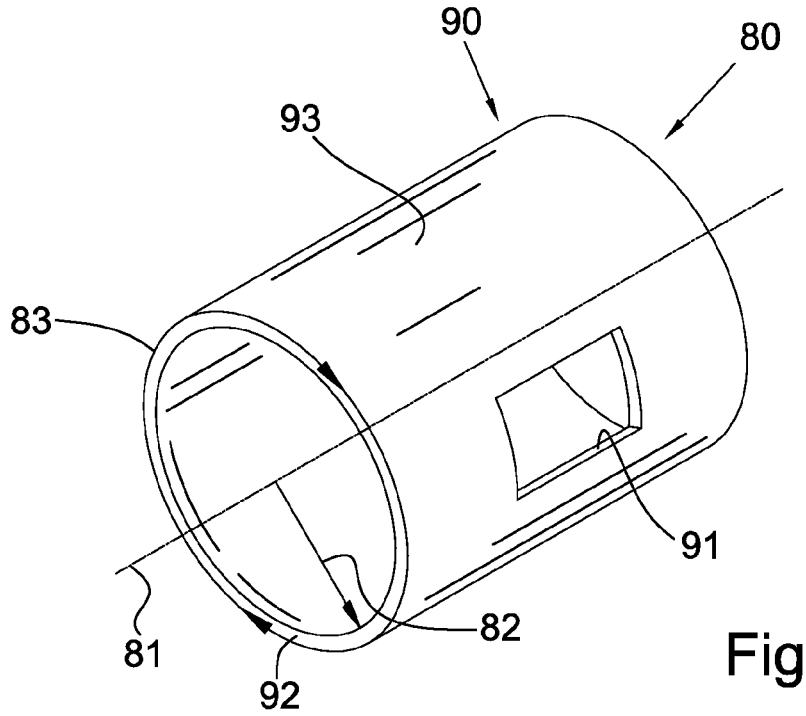
FIG. 1B is a perspective view of an object in the cylindrical coordinate system of FIG. 1A demonstrating spatial terminology used in the present application.

FIG. 1B is a perspective view of object 90 in cylindrical coordinate system 80 of FIG. 1A demonstrating spatial terminology used in the present application. Cylindrical object 90 is representative of a cylindrical object in a cylindrical coordinate system and is not intended to limit the present invention in any manner. Object 90 includes axial surface 91, radial surface 92, and circumferential surface 93. Surface 91 is part of an axial plane, surface 92 is part of a radial plane, and surface 93 is part of a circumferential plane.

Figure 2:
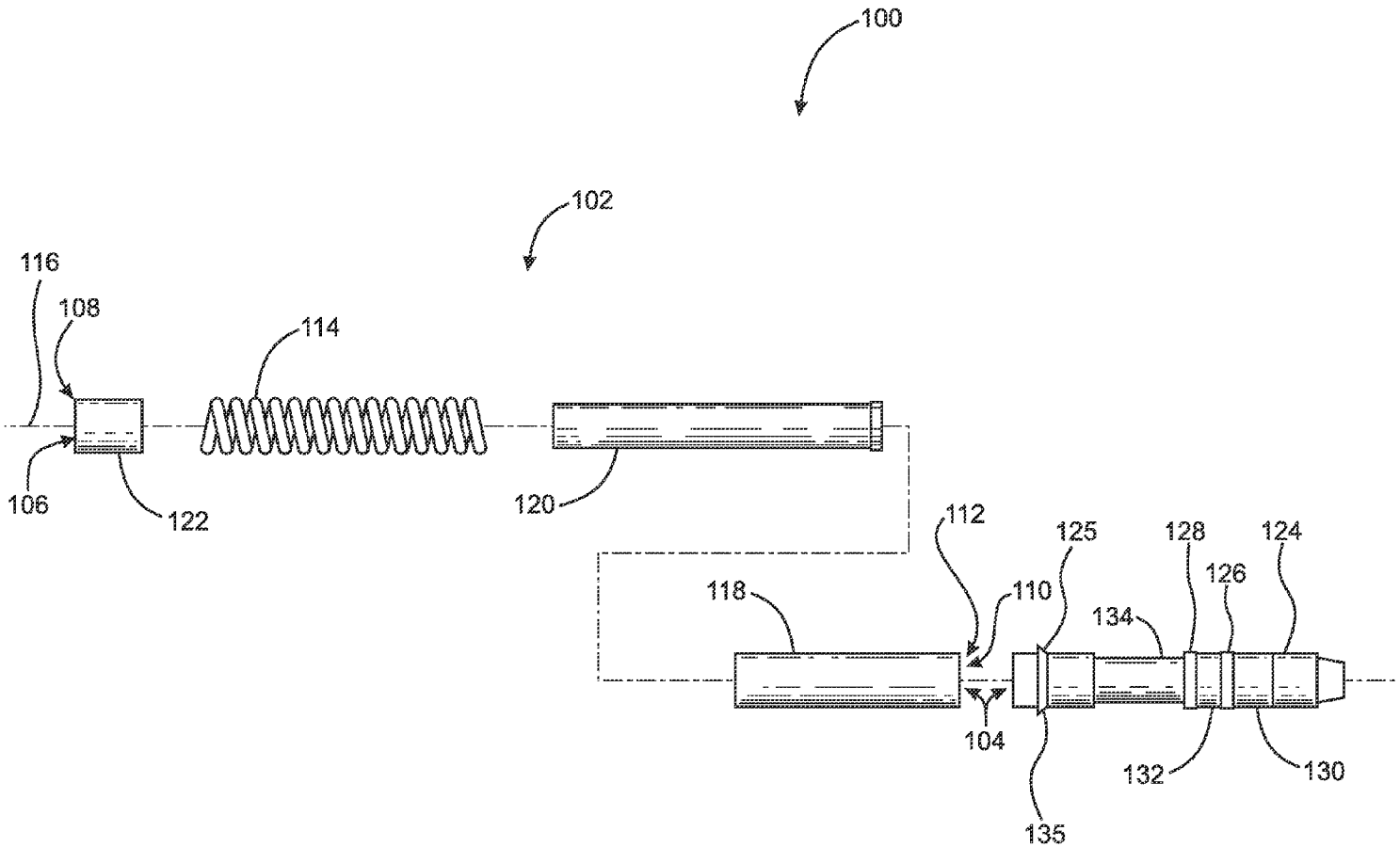
FIG. 2 is an exploded side view of a damping and sealing device for enabling gas or liquid flow from a well to a production tube in the well, and ancillary components.

FIG. 2 is an exploded side view of damping and sealing device 100, for enabling gas or liquid flow from a well to a production tube in the well, and ancillary components.

Figure 3:
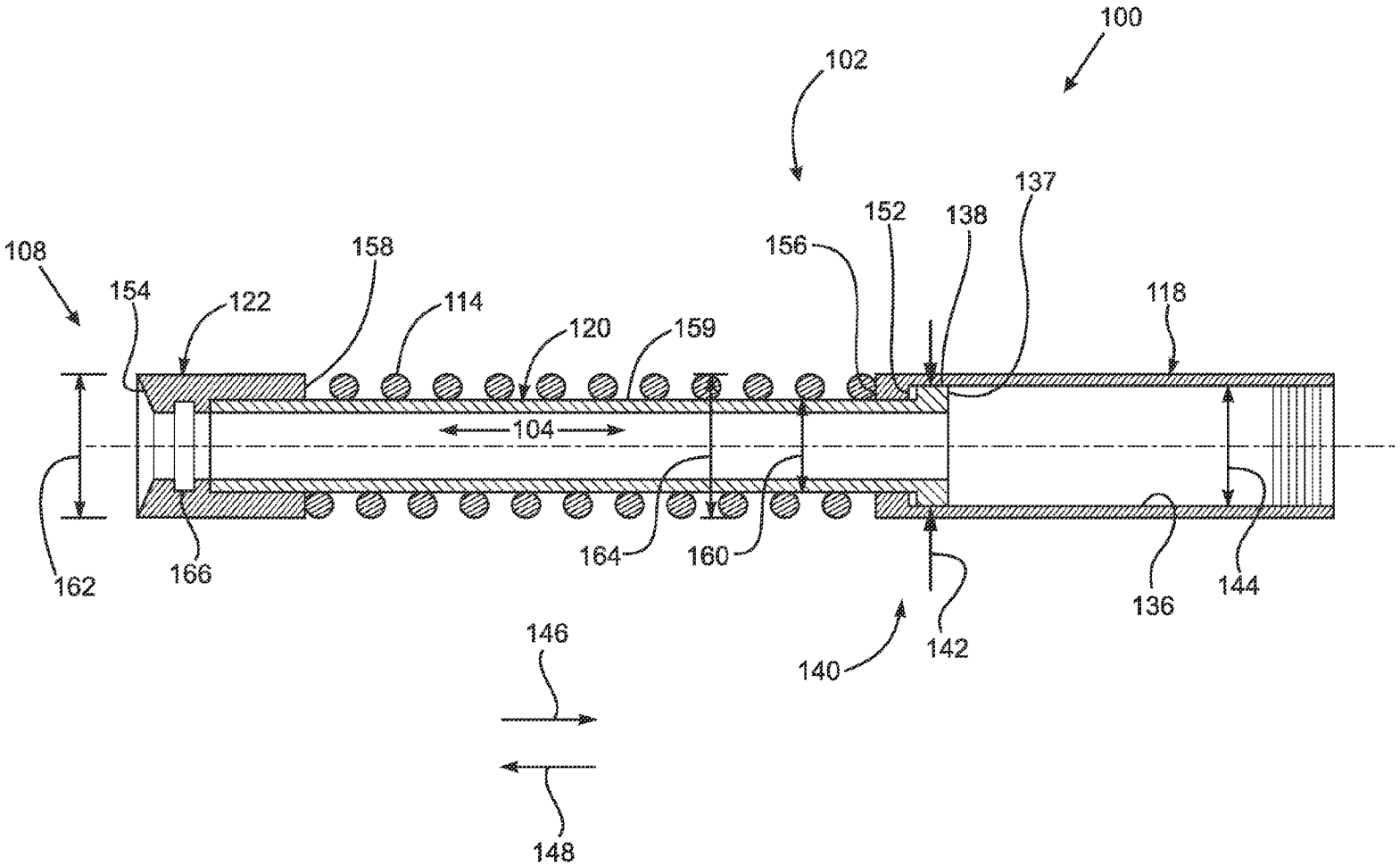
FIG. 3 is a cross section of the device in FIG. 2.
Figure 3A:
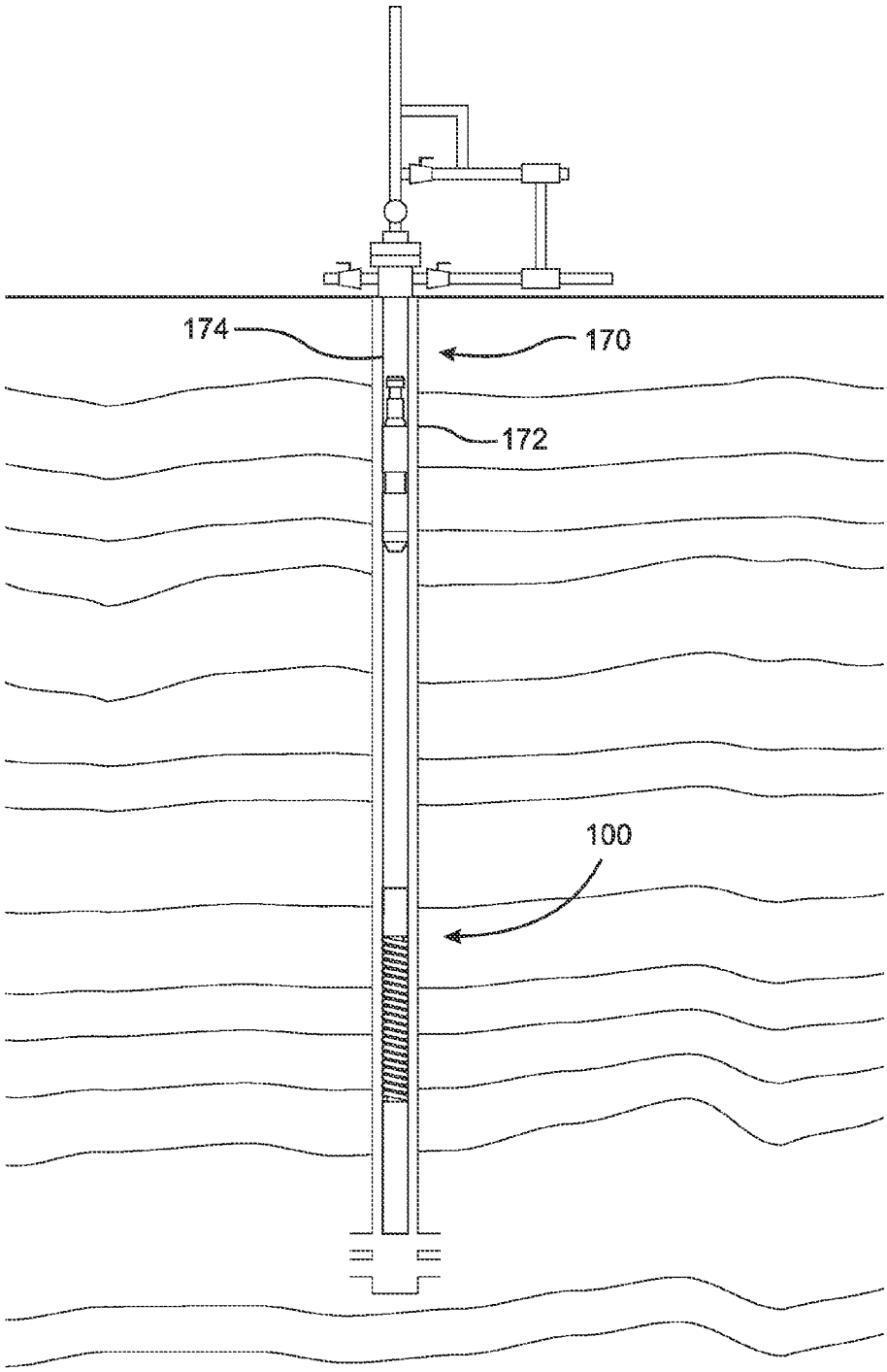
FIG. 3A is a side view of a typical, or conventional, well showing an example arrangement and location of the damping and sealing device shown in FIG. 2.
Figure 5:
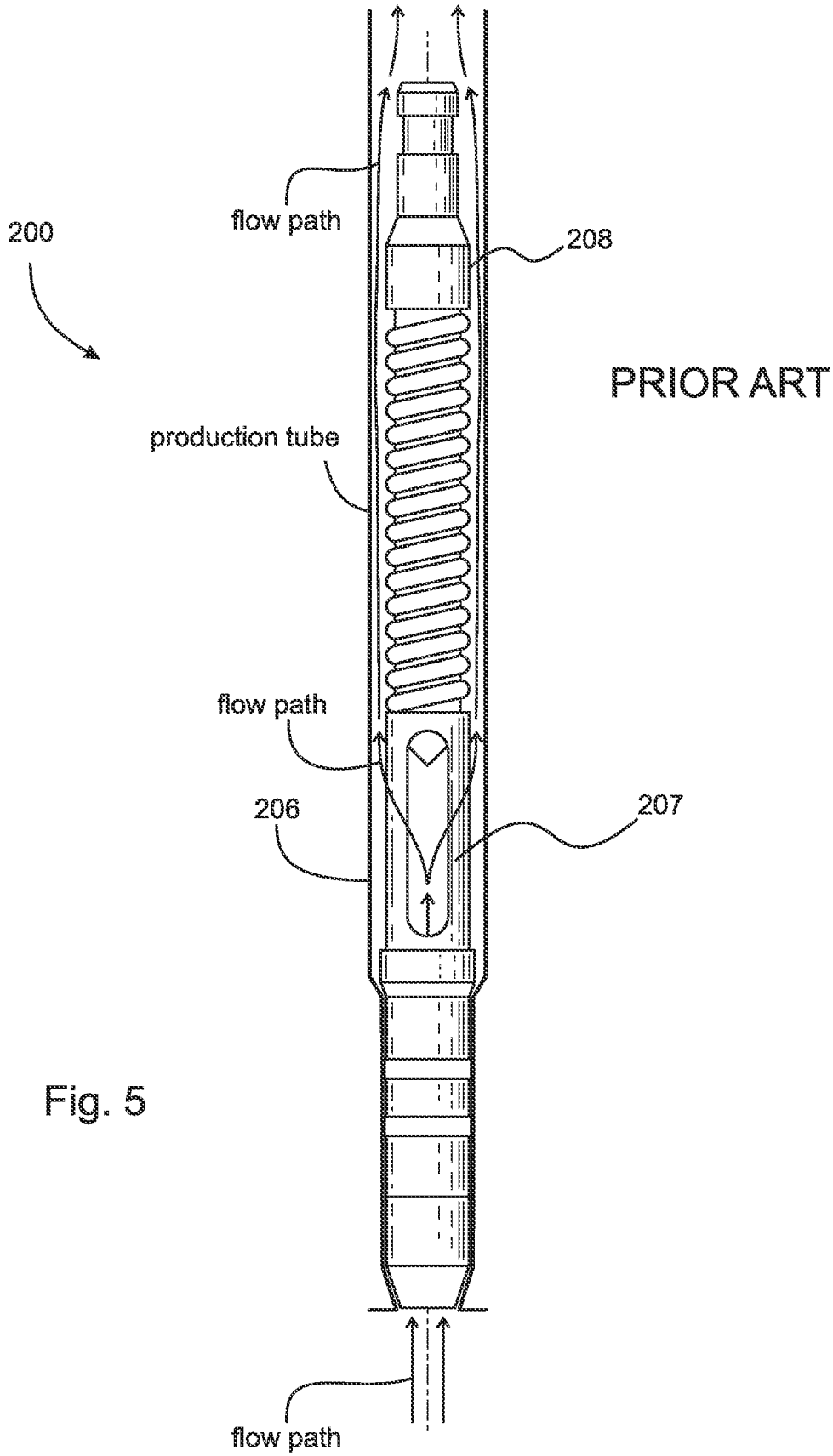
FIG. 5 is a cross-sectional view of a typical bumper spring in a production tube; and, FIG. 6 is a side view of a typical well showing an arrangement and location for a bumper spring.
Figure 6:
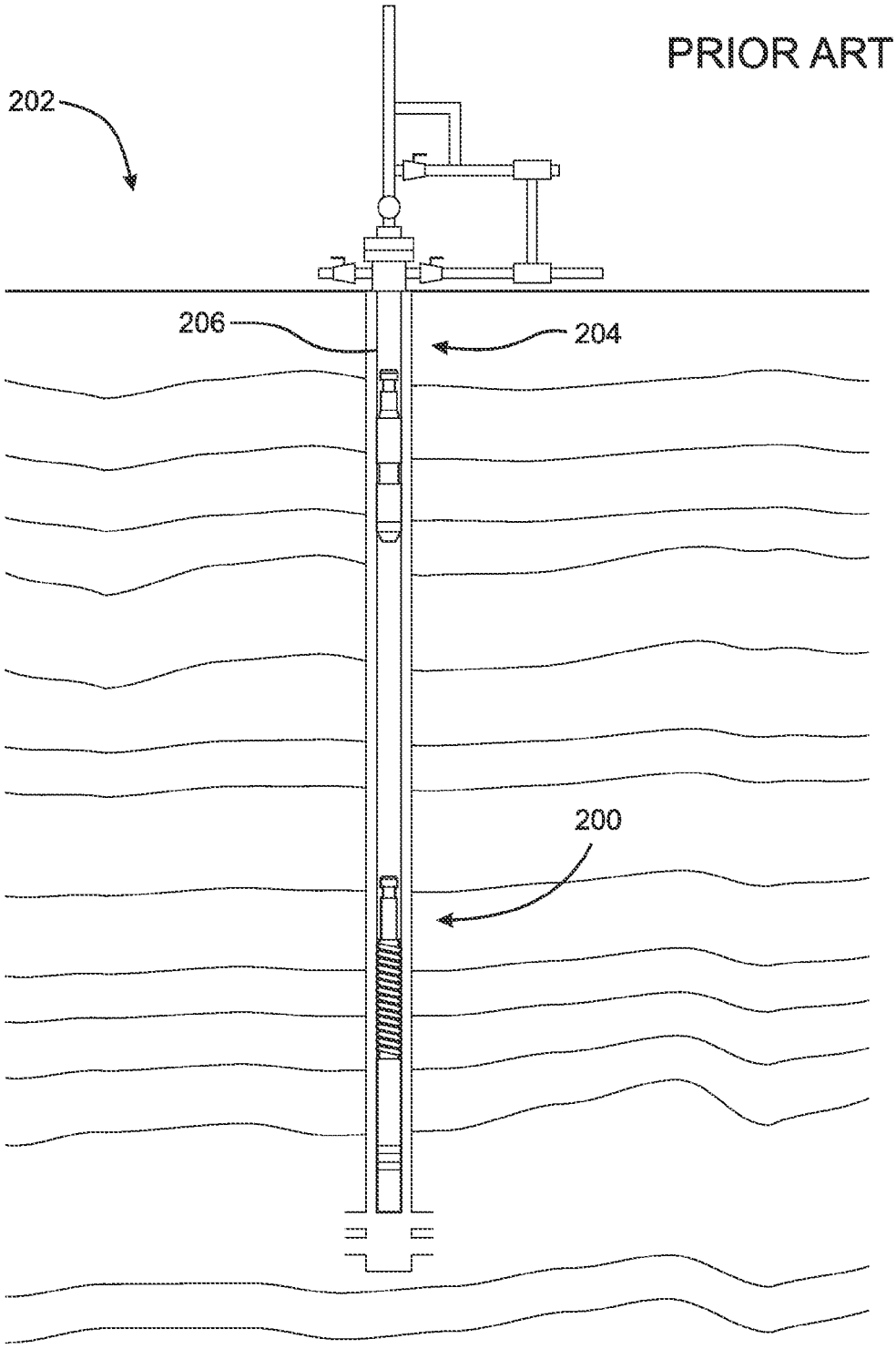

FIG. 3 is a cross section of device 100 in FIG. 2. FIG. 3A is a side view of a typical, or conventional, well 170 showing an example arrangement and location of damping and sealing device 100 shown in FIG. 2. The following should be viewed in light of FIGS. 2, 3, and 3A. Device 100, also referred to as a bottom hole bumper spring or a damping and sealing device, includes body 102 with a flow passage, also referred to as a flow path or channel, 104 internal to the body. Well 170 includes casing 172 and production tube 174. Plunger 176 is shown in the production tube. As further described infra, device 100 is arranged to enable fluid flow through production tube 174, or string, in a well. A typical well arrangement with a flow path restricted to the space through a sealing portion, the space between an outer circumference of the bumper spring and the production tube, and the area between the portion of the bumper spring impacted by a plunger and the inner diameter of the production tube is shown supra in FIG. 5.

By internal to the body, we mean that the body defines or encloses the passage. That is, the passage is surrounded by, or formed by, the body, as further described infra. Alternately stated, production from the well does not flow between the outer circumference of device 100 and the production tube, for example, as for the typical bumper springs described supra, but rather the production from the well flows inside device 100. The flow passage includes opening 106 at longitudinal end 108 of the body and opening 110 at longitudinal end 112 of the body. Spring 114 is disposed about a portion of the body. Longitudinal and special references infra are defined with respect to longitudinal axis 116. Flow through the flow passage can be, but is not limited to, gas, liquid, or any mixture of gas and liquid known in the art.

In an example embodiment, body 102 includes slide segment 118; spring segment 120; and plunger segment 122. The body is connected to ancillary pieces as known in the art to sealingly engage with the production string so that flow from the well is directed through channel 104. In an example embodiment, the following ancillary parts are connected to device 100: lower end 124, seals 126 and 128; spacer segments 130 and 132; and coupling 134. Ancillary parts can be joined by any means known in the art, for example, by mating threaded connections. It should be understood that other numbers, shapes, and configurations of ancillary parts can be used with device 100.

Alternately stated, passage 104 is an internal flow passage and the spring is disposed about portion 120 of the body radially aligned with the internal flow passage. That is, a portion of the body separates the flow passage and the spring. Specifically, portion 120 of the body is disposed between the flow passage and the spring. The description below is directed to an example embodiment as shown in FIGS. 2 and 3; however, it should be understood that device 100 is not limited to the example embodiment shown in FIGS. 2 and 3.

End 108 is arranged to contact plunger 176 for the well and body 102 is arranged to be sealingly engaged with the production string by any means known in the art. By sealingly engage, we mean that a substantially gas or liquid-tight seal is created between the device 100 and the ancillary parts noted supra and the production string. In an example embodiment, seals 126 and 128 are arranged to form a seal with the production tube. Thus, for example, due to the seal, the flow path from the production string through device 100 is formed by passage 104. That is, the seal described supra and infra forces flow through passage 104. As further described infra, the plunger segment and the spring provide a shock absorbing function with respect to functioning of a plunger. Flared segment (no go) 135 prevents device 100 from falling through the seating nipple. In an example embodiment, end 124 is tapered to facilitate insertion into the seating nipple.

In an example embodiment, segments 118 and 120 are slidingly engaged. For example, body 102, specifically, slide segment 118, includes inner circumferential surface 136 and the spring segment includes flange 137 with an outer circumferential surface, for example, surface 138 at interlocking portion 140 of segment 120. The inner circumferential surface forms a part of the internal flow passage, for example, the surface forms walls defining part of the passage. Portion 140 of the spring segment is for sliding along surface 136 in response to end 108 being contacted by a plunger, as described infra.

In an example embodiment, portion 140 forms an axially displaceable, or slideable, interlocking connection between segments 118 and 120. For example, outside diameter 142 of flange 137 is slightly less than inside diameter 144 of segment 118, enabling axial movement between flange 137 and segment 118. Movement of segment 120 in direction 146 is due to contact of a plunger with segment 122 and subsequent displacement of segment 122 in direction 146 and is limited by the compression of spring 114. For example, a maximum displacement of segment 120 in direction 146 occurs when the spring is fully compressed. Displacement of segment 120 in direction 148 is limited by contact of flange 137 with segment 118, for example, shoulder 152. That is, the flange and shoulder are at least partially axially aligned and movement of segment 120 in direction 148 eventually brings the flange and shoulder into contact, axially locking segments 118 and 120 in direction 148. Alternately stated, the spring segment is for sliding longitudinally within the slide segment in response to force applied to and removed from the plunger segment by a plunger. Segment 122 includes surface 154 configured to receive a plunger. In an example embodiment, the surface is beveled.

In an example embodiment, segment 118 includes shoulder 156 and segment 122 includes shoulder 158. Spring 114 is disposed between the shoulders. Specifically, the spring is axially restrained, or held, between the shoulders. In an example embodiment, spring 114 is partially compressed between shoulders 156 and 158 in a "neutral" position, that is, when segment 122 is not in contact with a plunger. In an example embodiment, segment 118 is held stationary due to flange 135 and the contact of seals 126 and 128 with the production tube. That is, the contact of flange 135 and seals 126 and 128 with the production tube prevents segment 118 from axially displacing further down the well, for example, in direction 146. Therefore, as a plunger contacts the plunger segment, the plunger segment is pushed in direction 146, compressing spring 114 in axial direction 146. The spring resists compression and thus absorbs the shock associated with the contact of the plunger with the plunger segment. Advantageously, due to the internal flow channel, the spring can be placed about outer surface 159 of the spring segment, increasing the size, strength, durability, and cushioning capacity of the spring. Increasing the cushioning capacity advantageously reduces the shock and wear on device 100 due to contact with a plunger.

Alternately stated, when a plunger contacts end 108, spring 114 absorbs the impact, and passage 104 advantageously remains open and unobstructed by the spring. For example, diameter 160 of the spring segment is not diminished or obstructed by the movement of segment 120, since spring 114 is disposed radially outside of the passage. As the energy from the plunger impact is dissipated by the spring, the spring recoils and displaces segment 122 back in direction 148.

The configuration of passage 104 advantageously reduces problems due to scale build-up and debris deposits, since the inner circumferential surface of passage 104 is relatively smooth and free of restrictions, discontinuities, and uneven surfaces at which scale build-up and debris deposits occur. Advantageously, these discontinuities are much less than the discontinuities in the flow path of a conventional bumper spring, for example, associated with a spring in the flow path.

The sliding action of flange 137 along surface 136 acts to scrape surface 136, further preventing build-up of deposits on passage 104. Further, debris, such as dislodged scale, pieces of a plunger, or sand, in the flow path, for example, passage 104, tends to fall down through the passage and out of device 100, rather than accumulating in passage 104, since passage 104 is substantially straight and planar and in alignment with gravitational flow through the passage.

In an example embodiment, the configuration of segment 122 enables an increase in the area of surface 154, which contacts a plunger. For example, diameter 162 of segment 122 can be nearly the same as the inner diameter of the production tube, since, unlike in a typical arrangement, it is not necessary to provide a flow path between segment 122 and the production tube. The increase in area for surface 154 increases the durability of the body, in particular, end 108 and segment 122.

Since the flow path for device 100 is through passage 104, internal to the device, and is not external to the device, for example, between an outer surface and spring for the device and the production string, outer diameter 164 of the spring can be advantageously increased. That is, the outer diameter of the spring does not need to be reduced to leave space between the spring and the production tube for an external flow path as is necessary for a flow path external to a typical bumper spring outer surface. For example, diameter 164 can be nearly equal to the inner diameter of the production string. Increasing the size of the spring advantageously increases the shock-absorbing capacity of device 100. The durability and service life of device 100 also is advantageously increased by the optimized cushioning. For example, increasing spring diameter improves cushioning, reducing shock and wear on down-hole parts.

Further, the lack of restrictions in flow path 104 minimizes pressure differential between the production tube and a space formed by an outer casing for the well and the production tube (from which gas or fluid is to be withdrawn), which in turn minimizes the build-up of scale. The lack of restrictions also increase flow from the space to the production tube.

In an example embodiment (not shown), device 100 includes a check valve, or standing valve, at least partly disposed in the internal flow passage. Any check valve configuration known in the art can be used.

In one embodiment, segment 122 includes receiving feature 166 arranged to engage a retrieval element, or tool, (not shown). In an example embodiment, feature 166 is a groove. In an example embodiment, the retrieval tool includes at least one downward protruding element. In an example embodiment, surface 154 includes a beveled lip and as the element is pushed in direction 146 and contacts the beveled lip, the element is radially compressed by contact with the lip. As the element slides down passage 104, the element reaches groove 166 and expands to "snap" into groove, locking the element in the groove. The retrieval tool can then be displaced in direction 148, drawing the element and device 100 in the same direction.

Figures 4A, 4B:
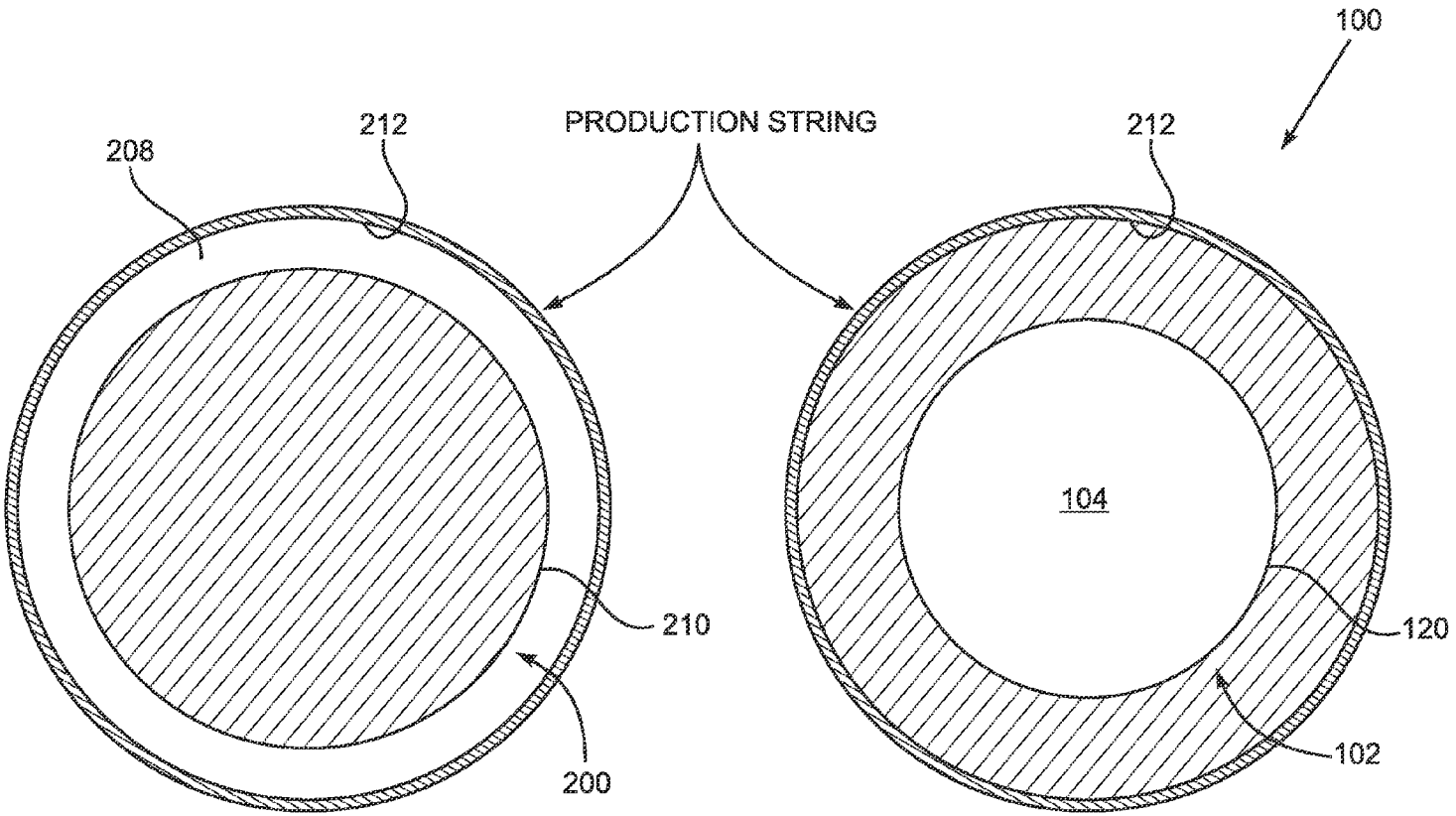
Fig. 4A PRIOR ART
FIG. 4A illustrates a cross-sectional flow area for the device shown in FIG. 2.
FIG. 4B is a prior art bumper spring, in a production string the same size as the production string shown in FIG. 4A.

FIG. 4A illustrates a cross-sectional flow area for device 100 shown in FIG. 2. FIG. 4B is a prior art bumper spring, in a production string the same size as the production string shown in FIG. 4A. The following should be viewed in light of FIGS. 2 through 6. In the discussion that follows, bumper spring 200 is used as an example; however, it should be understood that FIG. 4B and the discussion regarding bumper spring 200 are applicable to conventional bumper springs in general. Disposing passage 104, which forms a portion of the flow path through device 100, within body 102 advantageously minimizes the flow restriction problems associated with a conventional bumper spring. For example, conventional bumper spring 200 has flow path 208 between outer circumference 210 of the bumper spring and inner circumference 212 of the production string.

It should be understood that conventional bumper spring 200 and bumper spring 100 are substantially proportionally accurate with respect to the production string; therefore, the relative proportion of passage 104 with respect to flow area 208 is substantially accurate. Advantageously, passage 104 has a greater cross-sectional area than flow path 208. For example, in one embodiment, the cross-sectional area of passage 104 is greater than the cross-sectional area of 208 by 30% or more.

According to aspects illustrated herein, there is provided a method for producing a well. The method includes: sealing a damping and sealing device with a seating arrangement for a production tube in the well; and flowing gas or liquid from an annulus for the well through a first opening, proximate one longitudinal end of the device, to an internal channel in the device and through the internal channel and a second opening, proximate the other longitudinal end of the device, to the production tube. In an example embodiment, the method includes disposing a spring about an outer circumference of the device; impacting the other longitudinal end with a plunger; and cushioning, using the spring, force associated with impacting the other longitudinal end with the plunger.

It should be understood that a present invention device is not limited to the configuration shown in the figures. For example, different numbers and configurations of components can be used to obtain the claimed invention.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What I claim is:

1. A damping and sealing device for enabling gas or liquid flow from a well to a production tube in the well, comprising:
- a body including:
  - a plunger segment including a first longitudinal end of the body and arranged to receive a plunger in the well;
  - a slide segment including a second longitudinal end of the body, opposite the first longitudinal end; and,
  - a portion with a first end connected to the plunger segment and a second end disposed within the slide segment;
- a flow passage internal to the body and including a first opening at the first longitudinal end of the body and the second opening at a second longitudinal end of the body;
- a spring disposed about the portion and directly engaged with the plunger segment and the slide segment; and,
- an outer circumference formed by the plunger segment, the slide segment, the portion, and the spring, wherein:
  - the body is arranged to be installed with the production tube; and,
  - the body is arranged to sealingly engage the production tube.

2. The device of claim 1 wherein the slide segment includes an inner circumferential surface forming a portion of the flow passage, and wherein the portion includes an outer circumferential surface arranged to slide along the inner circumferential surface in response to the plunger contacting the plunger segment.

3. The device of claim 1 wherein the slide segment includes an inner circumferential surface forming a portion of the flow passage, and wherein the portion includes an outer circumferential surface slideable along the inner circumferential surface.

4. The device of claim 3 wherein the slide segment and the portion are interlocked.

5. The device of claim 1 wherein the slide segment includes an inner circumferential surface and the portion includes an outer circumferential surface and wherein a portion of the outer circumferential surface is slidingly engaged with a portion of the inner circumferential surface.

6. A damping and sealing device for enabling gas or liquid flow from a well to a production tube in the well, comprising:
- a body including:
  - a plunger segment including a first longitudinal end of the body and arranged to receive a plunger in the well;
  - a slide segment including a second longitudinal end of the body, opposite the first longitudinal end; and,
  - a portion including:
    - a first end connected to the plunger segment and having a first outside diameter; and,
    - a second end including a flange having a second outside diameter greater than the first outside diameter;
- a flow passage radially within the body and extending between the first and second longitudinal ends; and,
- a spring disposed about the portion, directly engaged with the plunger segment and the slide segment, and radially aligned with a portion of the flow passage, wherein:
  - the flange is disposed within a portion of the flow passage formed by the slide segment; and,
  - the flange is axially displaceable within the slide.

7. A damping and sealing device for enabling gas or liquid flow from a well to a production tube in the well, comprising:
- a body including:
  - a plunger segment including a first longitudinal end of the body and arranged to receive a plunger in the well;
  - a slide segment including a second longitudinal end of the body, opposite the first longitudinal end; and,
  - a portion including:
    - a first end connected to the plunger segment and having a first outside diameter; and,
    - a second end including a flange disposed within the slide segment and having a second outside diameter greater than the first outside diameter;
- a flow passage through the body from the first longitudinal end to the second longitudinal end;
- a spring surrounding the portion of the body, directly engaged with the plunger segment and the slide segment, and axially disposed between the plunger segment and the slide segment; and,
- an outer circumference formed by the plunger segment, the slide segment, the portion, and the spring, wherein:
  - the portion of the body is disposed between the flow passage and the spring;
  - the spring is arranged to compress and absorb force associated with impacting the first longitudinal end; and,
  - the flange is axially displaceable within the slide.

8. A method for producing a well, using a damping and sealing device including: a body with a plunger segment with a first longitudinal end of the body, a slide segment with a second longitudinal end of the body, opposite the first longitudinal end, and a portion with a first end connected to the plunger segment and having a first outside diameter and with a second end including a flange disposed within the slide segment and having a second outside diameter greater than the first outside diameter; a flow passage radially within the body; and a spring disposed about the portion, directly engaged with the plunger segment and the slide segment, and radially aligned with a portion of the flow passage, the method comprising:
- sealing the slide segment with a seating arrangement for a production tube in the well;
- impacting the plunger segment with a plunger;
- cushioning, using the spring, force associated with impacting the other longitudinal end with the plunger;

axially displacing the plunger segment and the portion toward the slide segment;

axially displacing the flange within the slide segment; and, flowing gas or liquid from a space between a casing for the well and the production tube through a first opening, at the second longitudinal end of the device, to the flow passage and through the flow passage and a second opening, at the first longitudinal end of the device, to the production tube.

* * * * *